US007000403B2

(12) United States Patent
Henriquez et al.

(10) Patent No.: US 7,000,403 B2
(45) Date of Patent: Feb. 21, 2006

(54) PRIMARY FUEL NOZZLE HAVING DUAL FUEL CAPABILITY

(75) Inventors: John Henriquez, Hobe Sound, FL (US); Jacob McLeroy, Stuart, FL (US); Brian R. Mack, Palm City, FL (US); Vincent C. Martling, Jupiter, FL (US)

(73) Assignee: Power Systems Mfg., LLC, Jupiter, FL (US)

( * ) Notice: Subject to any disclaimer, the term of this patent is extended or adjusted under 35 U.S.C. 154(b) by 41 days.

(21) Appl. No.: 10/799,970

(22) Filed: Mar. 12, 2004

(65) Prior Publication Data

US 2005/0198965 A1 Sep. 15, 2005

(51) Int. Cl.
*F02C 7/22* (2006.01)
*F23R 3/36* (2006.01)

(52) U.S. Cl. ..... 60/776; 60/742; 60/737; 60/748

(58) Field of Classification Search ..... 60/742, 60/737, 748, 776
See application file for complete search history.

(56) References Cited

U.S. PATENT DOCUMENTS

| | | | | |
|---|---|---|---|---|
| 3,853,273 | A * | 12/1974 | Bahr et al. | 60/748 |
| 4,342,198 | A | 8/1982 | Willis | |
| 5,228,283 | A | 7/1993 | Sciocchetti | |
| 5,295,352 | A * | 3/1994 | Beebe et al. | 60/742 |
| 5,355,670 | A | 10/1994 | Sciocchetti | |
| 5,833,141 | A | 11/1998 | Bechtel, II et al. | |
| 6,123,273 | A * | 9/2000 | Loprinzo et al. | 239/405 |
| 6,655,145 | B1 * | 12/2003 | Boardman | 60/737 |

* cited by examiner

*Primary Examiner*—Ted Kim

(57) ABSTRACT

A fuel nozzle and gas turbine combustor capable of operating on multiple fuels with reduced carbon build-up to the fuel nozzle and adjacent combustor components is disclosed. The fuel nozzle incorporates a reconfigured gas fuel assembly and mixing tube to eliminate known areas of recirculation. Furthermore, the liquid fuel assembly includes reconfigured spray characteristics to further reduce droplet interaction with the mixing tube.

19 Claims, 6 Drawing Sheets

PRIMARY FUEL NOZZLE HAVING DUAL FUEL CAPABILITY

TECHNICAL FIELD

This invention generally relates to gas turbine combustion systems and more specifically to a fuel nozzle having dual fuel capability.

BACKGROUND OF THE INVENTION

Land-based gas turbine engines, which are primarily used for generating electricity, include a combustion system that mixes fuel with compressed air from the engine compressor and contains the reaction that generates hot combustion gases to drive a turbine. The combustion system injects a fuel, typically natural gas or a liquid fuel, to mix with the compressed air. Combustion systems which inject either fuel type are typically referred to as dual fuel combustors. This type of combustion system offers flexibility to the engine operator with regard to which fuel to use, depending on fuel availability, fuel costs, and level of emissions allowed. While natural gas fired gas turbine engines have become increasingly popular due to lower levels of NOx emissions produced, not all regions of the world in which gas turbine engines operate are regulated by emissions nor is natural gas a desired fuel choice for economic reasons.

While dual fuel combustion systems provide the flexibility to operate on different fuel types, they have exhibited some shortcomings, especially during the liquid fuel operation. More specifically, the combustor hardware surrounding the liquid fuel nozzle has been known to exhibit carbon buildup over a period of time. Build up of carbon has resulted in poor performance and damage to the fuel nozzles and combustion liner components requiring premature repair and replacement. Often times, engine operators have been required to limit the amount of time operating on liquid fuel in order to limit the amount of carbon buildup.

A specific example of a fuel nozzle known to exhibit carbon buildup is shown in FIG. 1. Fuel nozzle 10 includes gas tip 11 and liquid nozzle 12, which includes a plurality of concentric tubes 13, 14, and 15. Inner tube 13 contains a liquid fuel such as oil, while middle tube 14 contains water, and outer tube 15 contains air. Surrounding liquid nozzle 12 is gas tip 11 that injects a gaseous fuel through injection holes 17 to mix with the surrounding air in mixing tube 16. Whether fuel nozzle 10 is operating on liquid fuel or gaseous fuel, the fluids mix in mixing tube 16. It is during the liquid fuel operation that this prior art design has exhibited carbon buildup along the tip region of fuel nozzle 10 and along mixing tube 16. The carbon buildup is a result of recirculation zones within mixing tube 16, particularly along the interface between fuel nozzle 10 and mixing tube 16, such that liquid fuel droplets are redirected to impinge on the tip of fuel nozzle 10 and along mixing tube 16, adhering to the surface and forming carbon deposits. Over time, the carbon deposits build-up to a level that impairs fuel nozzle and combustor performance, requiring repair and replacement.

Referring to FIGS. 2 and 3, a second prior art fuel nozzle 30 is shown in detail and is the subject of U.S. Pat. No. 5,833,141. In order to prevent the carbon build up exhibited in fuel nozzle 10, fuel nozzle 30 was positioned such that the liquid nozzle portion extended the full length of the mixing tube and is combined with an additional outer swirler 31 and therefore reduced the possibility of recirculation of liquid fuel droplets onto the fuel nozzle or mixing tube 36. While this design has proven to reduce the amount of carbon buildup, it requires modifications to the gas/air swirler of the prior art fuel nozzle 10, including extending the swirler channel and incorporating an additional outer swirler.

SUMMARY AND OBJECTS OF THE INVENTION

The present invention improves upon each of the prior art dual fuel nozzles by providing a fuel nozzle designed to reduce carbon buildup while having a relatively simple fuel nozzle configuration. The present invention positions the injection point of the liquid fuel portion approximately halfway in a mixing tube and utilizes a reconfigured spray angle and air swirler and alternate mixing tube to eliminate recirculation areas found in the prior art fuel nozzle.

A fuel nozzle for use in a dual fuel gas turbine combustion system is disclosed having a fuel nozzle axis, nozzle tip, and comprising a liquid fuel assembly having coaxial tubes for flowing a liquid fuel, water, and compressed air and a gas fuel assembly comprising a nozzle body that injects a gaseous fuel to mix with surrounding compressed air. The first, second, and third tubes of the liquid fuel assembly and the nozzle body of the gas fuel assembly each extend to proximate the nozzle tip.

The present invention dual fuel nozzle is designed to operate in a gas turbine combustor comprising a combustion liner with a cap assembly fixed to a first end of the combustion liner. The cap assembly has a plurality of openings located about the combustion liner center axis, with each of the openings having a convergent—divergent mixing tube with a forward tube end and aft tube end and a collar positioned adjacent the forward tube end of the mixing tube. The dual fuel nozzles of the present invention are arranged in an annular array about the center liner axis corresponding to the openings in the cap assembly and extend into the mixing tubes to a position approximately halfway between the forward tube end and the aft tube end. Positioning the dual fuel nozzle of the present invention in this location in combination with optimizing the spray orientation of the liquid fuel assembly and reconfigured mixing tube ensures that liquid fuel droplets will not contact the fuel nozzle surface or mixing tube wall, thereby minimizing carbon buildup along said surfaces.

It is an object of the present invention to provide a gas turbine combustor that can operate on multiple fuel types and exhibit reduced carbon deposits.

It is another object of the present invention to provide a dual fuel nozzle that injects a liquid fuel that does not recirculate and impinge on the fuel nozzle tip or cap assembly mixing tube wall.

In accordance with these and other objects, which will become apparent hereinafter, the instant invention will now be described with particular reference to the accompanying drawings.

DETAILED DESCRIPTION OF THE PREFERRED EMBODIMENT

Figure 3:
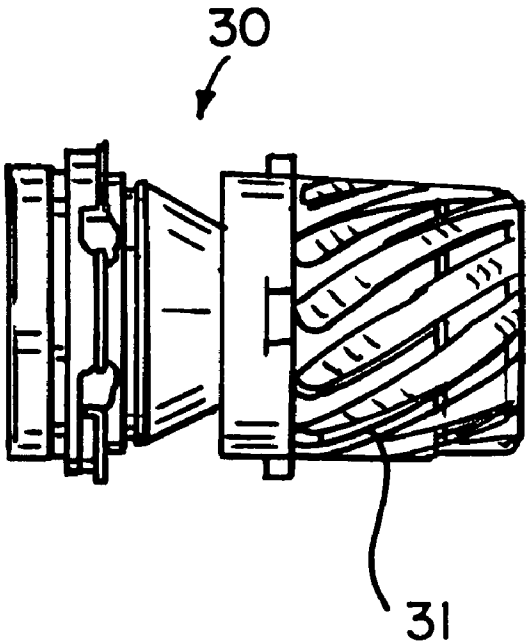
FIG. 3 PRIOR ART
FIG. 3 is an elevation view of an alternate dual fuel nozzle of the prior art.
Figure 1:
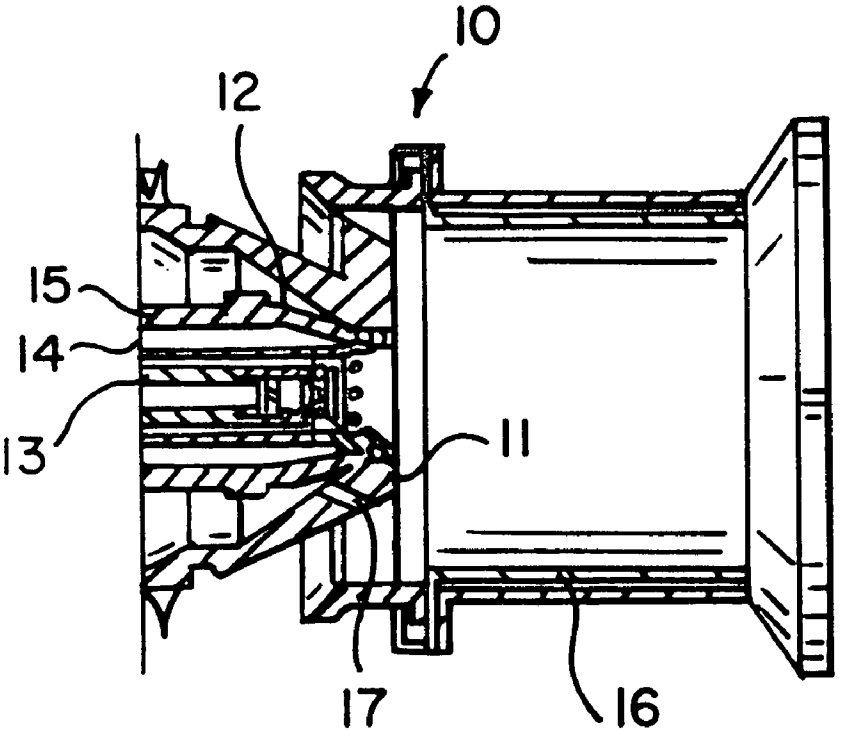
FIG. 1 PRIOR ART
FIG. 1 is a cross section of a dual fuel nozzle of the prior art.
Figure 2:
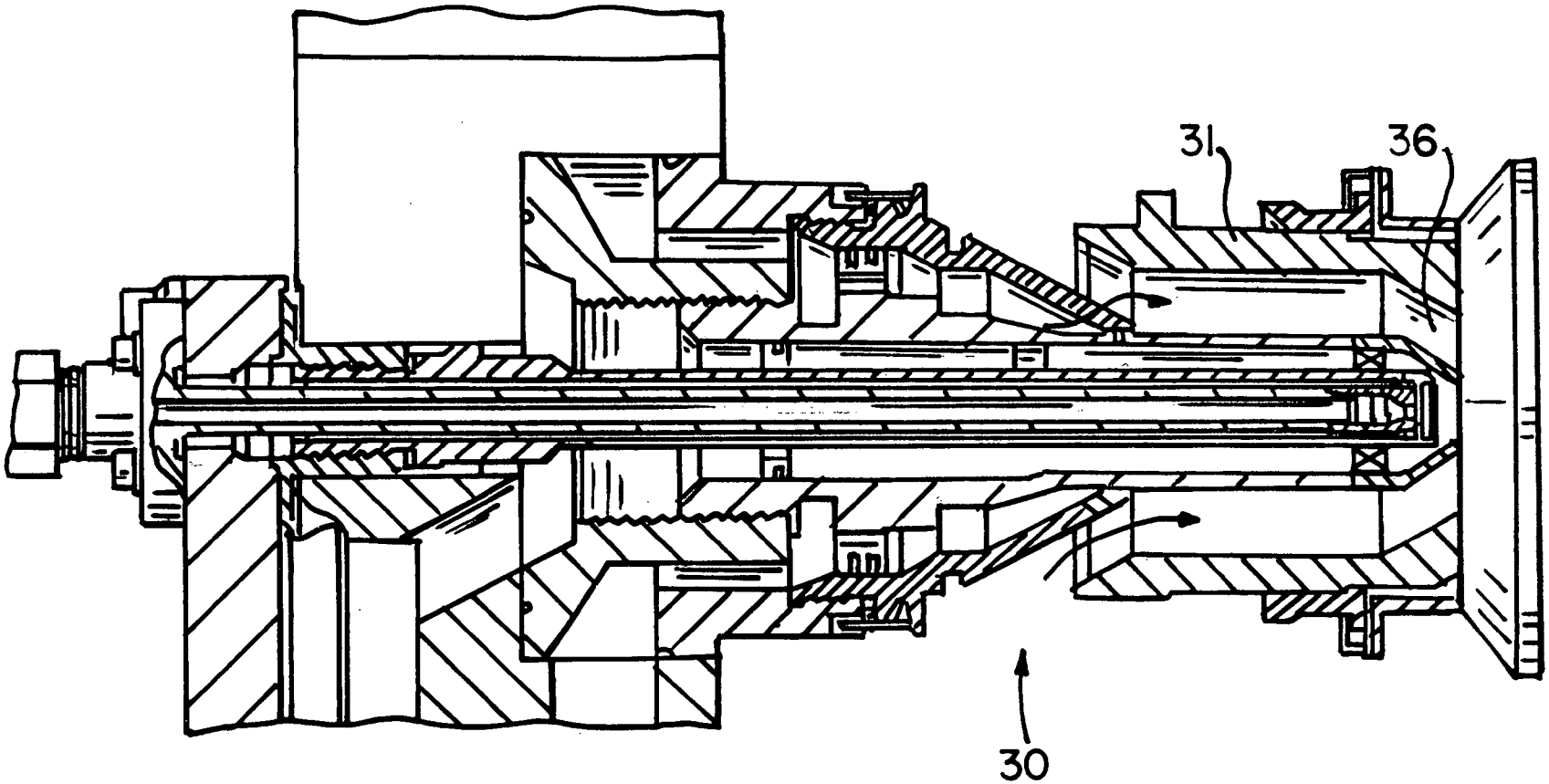
FIG. 2 PRIOR ART
FIG. 2 is a cross section of an alternate dual fuel nozzle of the prior art.
Figure 4:
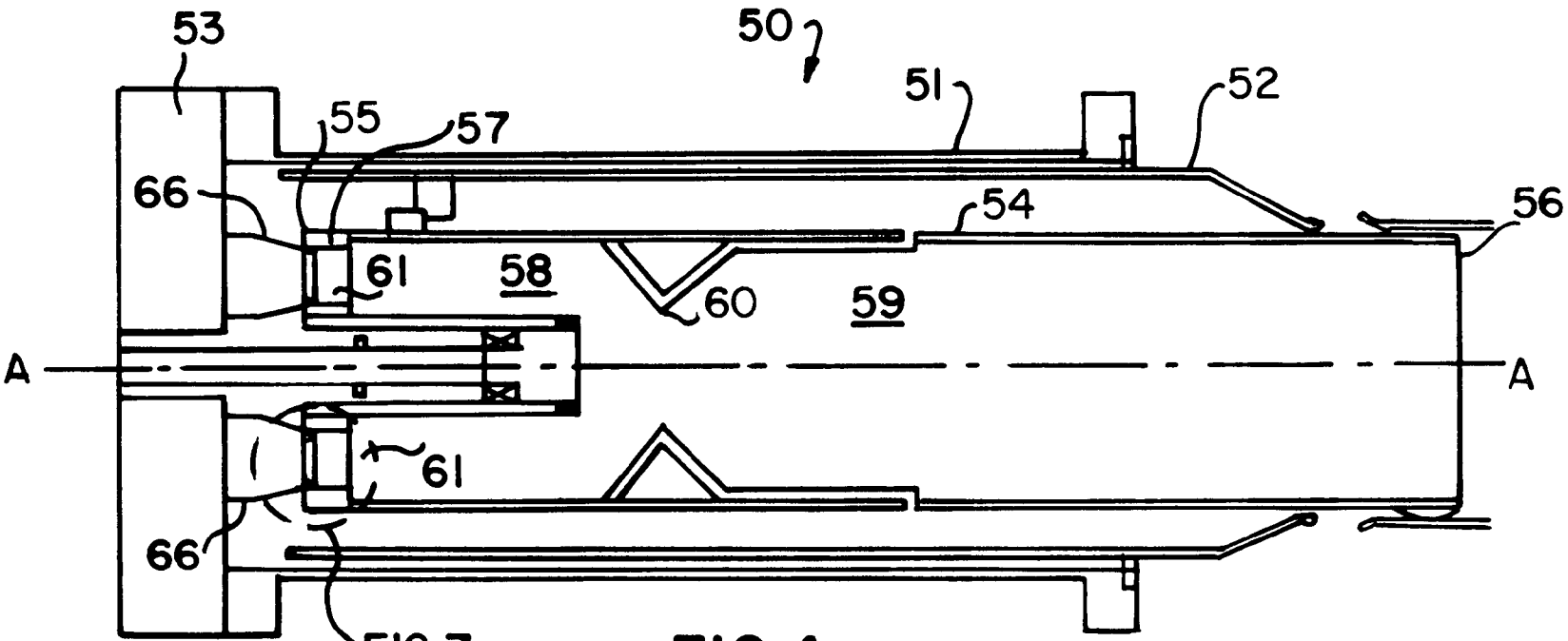
FIG. 4 is a cross section view of a gas turbine combustor in which the present invention can operate.
Figure 5:
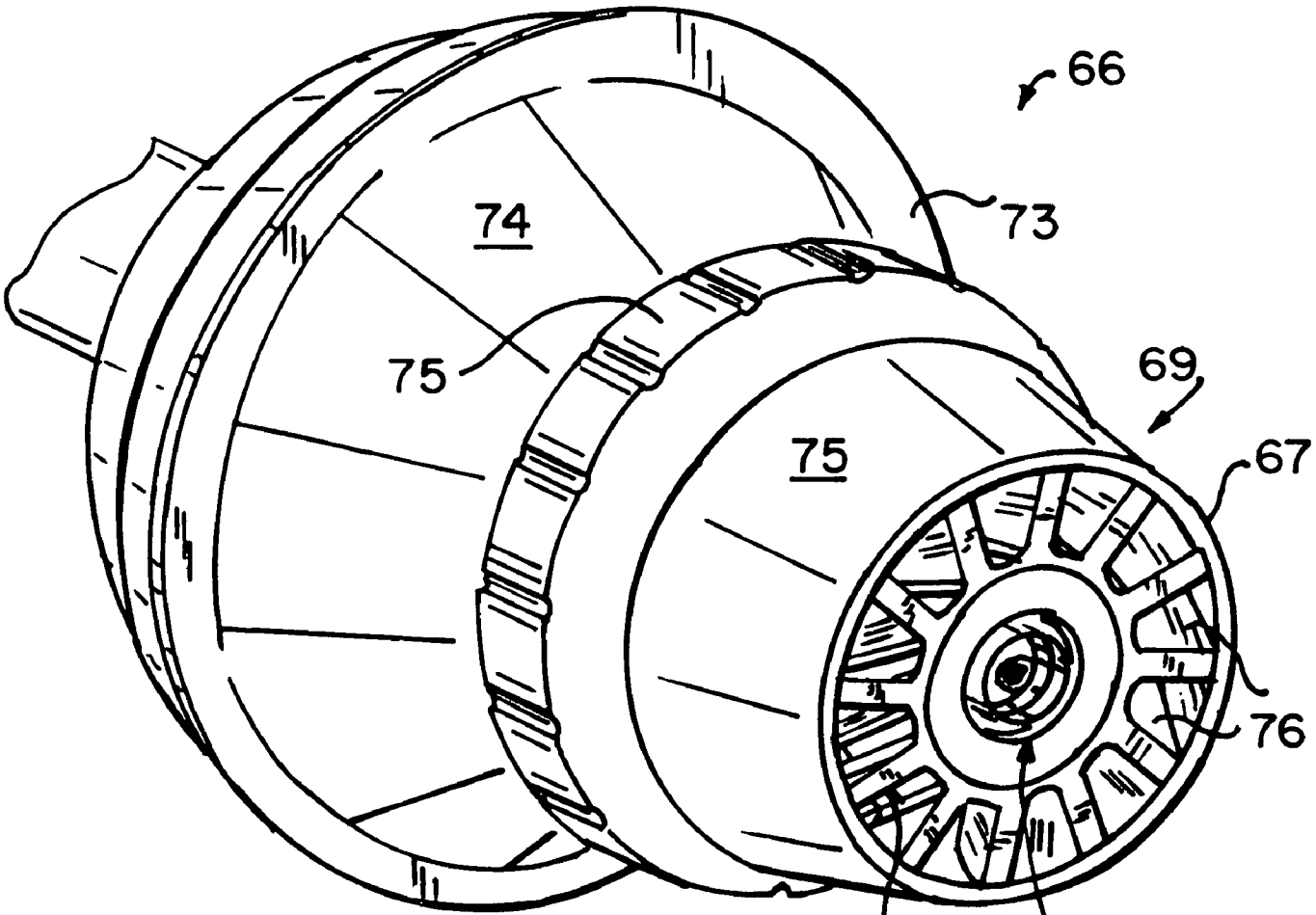
FIG. 5 is a perspective view of a dual fuel nozzle in accordance with the present invention.
Figure 6:
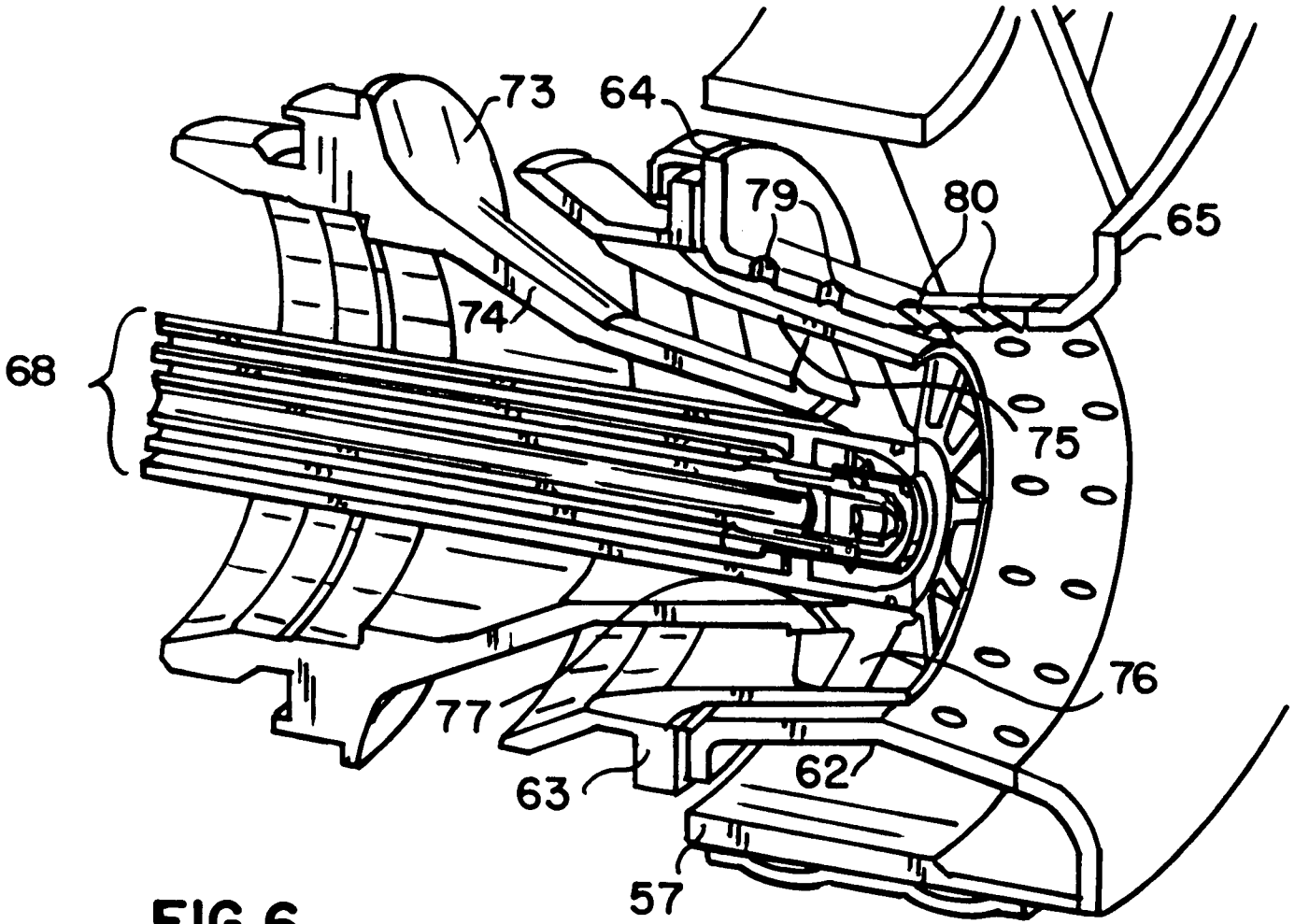
FIG. 6 is a perspective view taken in cross section of a dual fuel nozzle installed in a combustor in accordance with the present invention.

The present invention is shown in detail in FIGS. 4–7 and is preferably operated in conjunction with a dual stage combustion system such as that shown in FIG. 4. A gas turbine combustor 50 capable of operating on multiple fuels comprises an outer case 51, a sleeve 52, an end cover 53 fixed to a forward end of case 51, and a generally cylindrical combustion liner 54. The combustion liner comprises a first end 55, a second end 56 and a cap assembly 57 fixed to combustion liner 54 proximate first end 55 and located generally within combustion liner 54. Furthermore, combustion liner 54 also comprises a first combustion chamber 58, a second combustion chamber 59, and a venturi 60 separating chambers 58 and 59. Further details of cap assembly 57 can be seen in detail in accordance with FIG. 7. Cap assembly 57 has a plurality of openings 61 located about center line axis A—A, with each of openings 61 having a mixing tube 62 and collar 63. Mixing tube 62 has a forward tube end 64 and an aft tube end 65, with aft tube end 65 proximate opening 61 and collar 63 positioned adjacent forward tube end 64 of mixing tube 62.

Fixed to end cover 53 and arranged about center liner axis A—A, is a plurality of fuel nozzles 66, with each nozzle corresponding to an opening 61 in cap assembly 57. Fuel nozzles 66, which are shown in greater detail in FIGS. 5–7, have a fuel nozzle axis B—B, a nozzle tip 67, and comprise a liquid fuel assembly 68 and a gas fuel assembly 69.

Liquid fuel assembly 68 comprises a plurality of generally concentric tubes that extend to proximate nozzle tip 67 and are coaxial with fuel nozzle axis B—B. A first tube 70 extends substantially along fuel nozzle axis B—B and contains a liquid fuel such as No. 2 diesel fuel. Surrounding first tube 70 is a second tube 71 that preferably contains water and surrounding second tube 71 is a third tube 72 that contains compressed air.

Gas fuel assembly 69 comprises a nozzle body 73 that is generally conical and tapers generally inward at nozzle tip 67 towards fuel nozzle axis B—B and surrounds third tube 72 of liquid fuel assembly 68. Nozzle body 73 has a first wall 74, a second wall 75, and a plurality of swirler vanes 76 extending therebetween, and contains natural gas that passes between third tube 72 and nozzle body 73 and is injected into a passing flow of swirling compressed air by a plurality of injection holes 77. Nozzle body 73 is positioned within collar 63 and mixing tube 62 such that a portion of second wall 75 is in contact with collar 63. As with liquid fuel assembly 68, nozzle body 73 of gas fuel assembly 69 also extends to proximate nozzle tip 67.

The present invention incorporates multiple improvements to the mixing tube region of cap assembly 57 and nozzle body 73 to discourage recirculation of liquid fuel droplets and thereby reduce the amount of carbon deposits on nozzle tip 67 and mixing tube 62. The first improvement to mixing tube 62 is with respect to the tube shape. Mixing tube 62 has generally conical first and second portions with first portion 62A converging towards a mixing tube throat 78 and second portion 62B diverging from the mixing tube throat. The use of a converging—diverging mixing tube geometry directs the initial air flow away from from the mixing tube walls.

Figure 7:
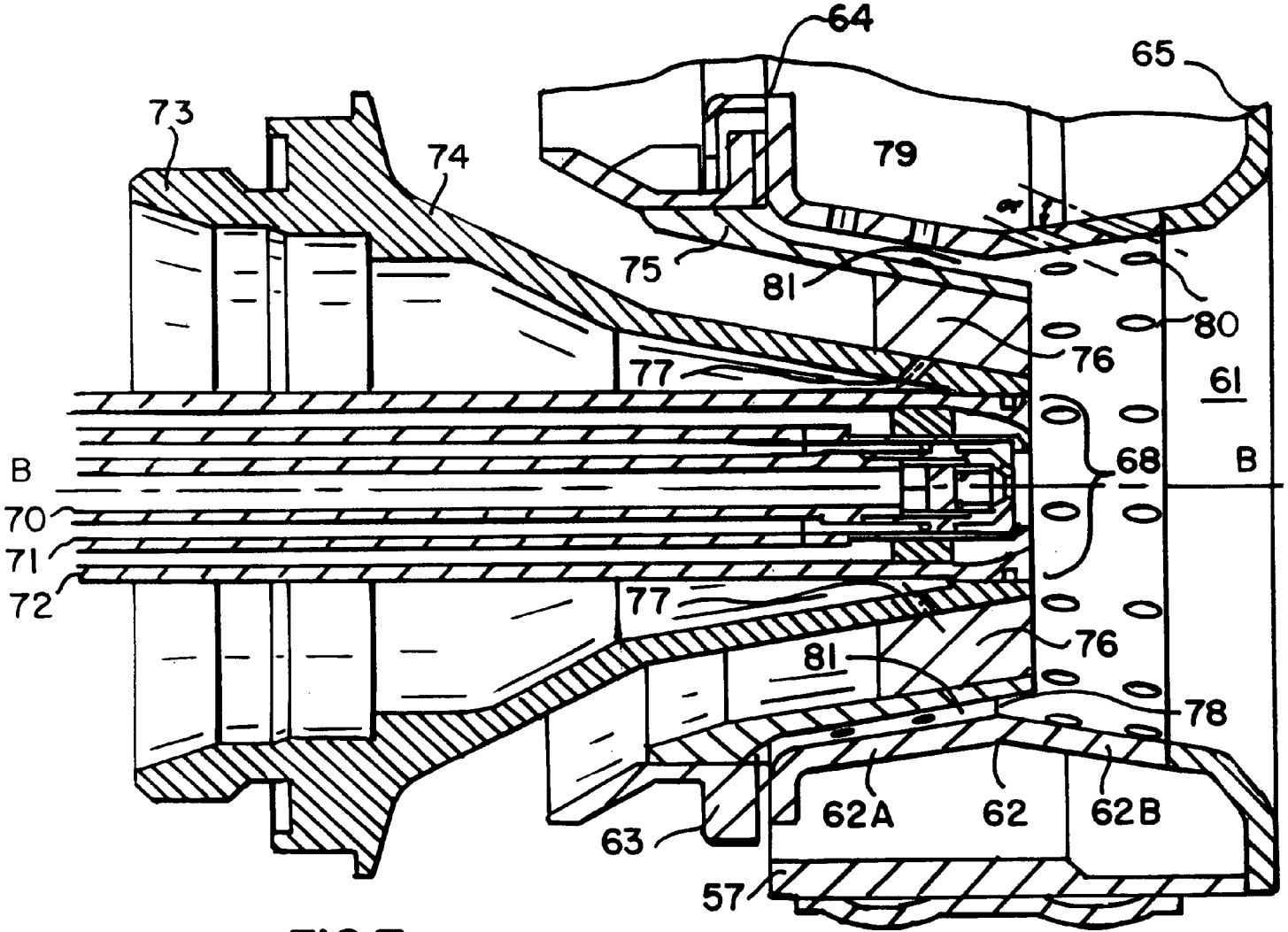
FIG. 7 is a detailed cross section of a dual fuel nozzle in accordance with the present invention.

The second improvement to mixing tube 62 constitutes a plurality of air injection holes for cooling and for providing a film of air to mixing tube 62 to prevent liquid fuel droplets from adhering to the tube. First portion 62A has a plurality of first cooling holes 79 and second portion 62B has a plurality of second cooling holes 80. In the preferred embodiment, plurality of first cooling holes 79 are oriented generally perpendicular to first portion 62A as shown in FIG. 7. Alternatively, plurality of second cooling holes 80 are oriented at an angle $\alpha$ relative to mixing tube 62 and towards aft tube end 65 of mixing tube 62. Second cooling holes 80 are oriented at angle $\alpha$ in order to provide a film of cooling air along second portion 62B. It is preferred that angle $\alpha$ is between 15 and 45 degrees. Cooling air enters through plurality of first holes 79 and impinges along the outer portion of nozzle body second wall 75. The cooling air then flows through passage 81 that is created between nozzle body second wall 75 and mixing tube first portion 62A. This cooling air provides a stream of fluid to prevent recirculation of fuel onto second portion 62B of mixing tube 62. Furthermore, should any fuel droplets penetrate this stream of air from passage 81, a film of air is covering second portion 62B, thereby preventing these fuel droplets from bonding to second portion 62B and causing a carbon build-up.

The final appreciable improvement of the present invention relates to the position of fuel nozzle tip 67 relative to the new and improved mixing tube design. In order to prevent interaction between fuel droplets and second portion 62B of mixing tube 62, fuel nozzle tip 67 is positioned approximately halfway between forward tube end 64 and aft tube end 65 of mixing tube 62 at mixing tube throat 78. The fuel nozzle is positioned such that the spray angle from liquid fuel assembly 68 in combination with the surrounding streams of air significantly avoids mixing tube second portion 62B.

While the invention has been described in what is known as presently the preferred embodiment, it is to be understood that the invention is not to be limited to the disclosed embodiment but, on the contrary, is intended to cover various modifications and equivalent arrangements within the scope of the following claims.

What we claim is:

1. A gas turbine combustor capable of operating on multiple fuels with reduced carbon buildup, said combustor comprising:

a generally cylindrical combustion liner having a center liner axis, a first end, and a second end;

a cap assembly fixed to said combustion liner proximate said first end and located generally within said combustion liner, said cap assembly having a plurality of openings located about said center liner axis, each of said openings having a mixing tube and a collar, with said mixing tube having a forward tube end and an aft tube end with said aft tube end proximate said opening, and said collar positioned adjacent said forward tube end of said mixing tube;

a plurality of fuel nozzles arranged about said center liner axis, each of said fuel nozzles corresponding to one of said openings, and having a fuel nozzle axis, a nozzle tip, and comprising:

a liquid fuel assembly comprising:

a first tube extending substantially along said fuel nozzle axis;

a second tube surrounding said first tube;

a third tube surrounding said second tube, a gas fuel assembly comprising:

a nozzle body surrounding said third tube of said liquid fuel assembly, said nozzle body having a first wall, a second wall, and a plurality of swirler vanes extending therebetween; and, wherein each of said first, second, and third tubes extend to proximate said nozzle tip, said nozzle body extends to proximate said nozzle tip, and said nozzle tip is located approximately halfway between said forward tube end and said aft tube end of said mixing tube.

2. The gas turbine combustor of claim 1 wherein a portion of said second wall of said nozzle body is in contact with said collar of said cap assembly.

3. The gas turbine combustor of claim 1 wherein said nozzle body is generally conical and tapers generally inward at said nozzle tip towards said fuel nozzle axis.

4. The gas turbine combustor of claim 1 wherein said mixing tube of said cap assembly has generally conical first and second portions with said first portion converging towards a mixing tube throat and said second portion diverging from said mixing tube throat.

5. The gas turbine combustor of claim 4 wherein said first portion of said mixing tube having a plurality of first cooling holes and said second portion of said mixing tube having a plurality of second cooling holes.

6. The gas turbine combustor of claim 5 wherein said plurality of first cooling holes is oriented generally perpendicular to said first portion of said mixing tube.

7. The gas turbine combustor of claim 5 wherein said plurality of second cooling holes is oriented at an angle relative to said mixing tube and towards said aft tube end of said mixing tube.

8. The gas turbine combustor of claim 7 wherein said angle of said second cooling holes is between 15 and 45 degrees.

9. The gas turbine combustor of claim 1 wherein said nozzle tip is proximate a mixing tube throat.

10. The gas turbine combustor of claim 1 wherein said first tube of said liquid fuel assembly contains a liquid fuel, such as No. 2 diesel fuel.

11. The gas turbine combustor of claim 1 wherein said second tube of said liquid fuel assembly contains water.

12. The gas turbine combustor of claim 1 wherein said third tube of said liquid fuel assembly contains compressed air.

13. The gas turbine combustor of claim 1 wherein natural gas passes between said third tube and said nozzle body first wall and is injected into a passing flow of swirling compressed air by a plurality of gas injection holes.

14. A fuel nozzle for use in a dual fuel gas turbine combustion system, said fuel nozzle having a fuel nozzle axis, a nozzle tip, and comprising:

a liquid fuel assembly comprising:

a first tube extending substantially along said fuel nozzle axis;

a second tube surrounding said first tube;

a third tube surrounding said second tube;

a gas fuel assembly comprising:

a nozzle body surrounding said third tube of said liquid fuel assembly, said nozzle body having a first wall, a second wall, and a plurality of swirler vanes extending therebetween;

wherein each of said first, second, and third tubes extend to proximate said nozzle tip, said nozzle body extends to proximate said nozzle tip, and said nozzle tip is located at a position approximately halfway between a forward tube end and an aft tube end of a mixing tube, such that a sufficient distance is provided for mixing of a gaseous fuel and air while minimizing interaction between a liquid fuel and said mixing tube.

15. The fuel nozzle of claim 14 wherein said nozzle body is generally conical and tapers generally inward at said nozzle tip towards said fuel nozzle axis.

16. The fuel nozzle of claim 14 wherein said first tube of said liquid fuel assembly contains a liquid fuel, such as No. 2 diesel fuel.

17. The fuel nozzle of claim 14 wherein said second tube of said liquid fuel assembly contains water.

18. The fuel nozzle of claim 14 wherein said third tube of said liquid fuel assembly contains compressed air.

19. The fuel nozzle of claim 14 wherein gas passes between said third tube and said nozzle body first wall and is injected into a passing flow of swirling compressed air by a plurality of gas injection holes.

* * * * *